US009607559B2

(12) United States Patent
Wen et al.

(10) Patent No.: US 9,607,559 B2
(45) Date of Patent: Mar. 28, 2017

(54) CHARGE-SHARING CONTROLLING METHOD AND DISPLAY PANEL

(71) Applicant: AU Optronics Corporation, Hsin-Chu (TW)

(72) Inventors: Chun-Kuei Wen, Hsin-Chu (TW); Yu-Ting Huang, Hsin-Chu (TW); Hung-Min Shih, Hsin-Chu (TW); Tian-Hua Su, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 98 days.

(21) Appl. No.: 14/496,373

(22) Filed: Sep. 25, 2014

(65) Prior Publication Data

US 2015/0109347 A1 Apr. 23, 2015

(30) Foreign Application Priority Data

Oct. 18, 2013 (TW) ..... 102137726 A

(51) Int. Cl.
*G09G 3/36* (2006.01)

(52) U.S. Cl.
CPC ..... *G09G 3/3607* (2013.01); *G09G 3/3614* (2013.01); *G09G 2300/0426* (2013.01); *G09G 2330/023* (2013.01)

(58) Field of Classification Search
CPC ..... G09G 3/3607; G09G 3/3614
See application file for complete search history.

(56) References Cited

U.S. PATENT DOCUMENTS

| | | | | |
|---|---|---|---|---|
| 7,812,807 | B2 | 10/2010 | Yano et al. | |
| 8,325,126 | B2 | 12/2012 | Cheng et al. | |
| 2005/0219195 | A1* | 10/2005 | Yano | G09G 3/3614 345/100 |
| 2007/0242019 | A1 | 10/2007 | Jung et al. | |
| 2013/0135273 | A1* | 5/2013 | Lee | G09G 3/3688 345/211 |
| 2013/0257829 | A1* | 10/2013 | Moh | G09G 3/36 345/204 |
| 2014/0104260 | A1 | 4/2014 | Chang et al. | |

FOREIGN PATENT DOCUMENTS

| | | |
|---|---|---|
| CN | 101059941 | 10/2007 |
| TW | 200830240 | 7/2008 |

* cited by examiner

*Primary Examiner* — Afroza Chowdhury
(74) *Attorney, Agent, or Firm* — WPAT, PC; Justin King

(57) ABSTRACT

A charge-sharing controlling method and a display panel are disclosed. The charge-sharing controlling method is suitable for the display panel including plural sub-pixels. The charge-sharing controlling method includes following steps: determining whether the display panel is displaying a primary color screen; if the display panel is displaying a primary color screen, prolonging an activated time of a charge-sharing circuit, which is coupled between any two of the sub-pixels displaying the same color, adjacent to each other and having opposite polarities.

8 Claims, 7 Drawing Sheets

CHARGE-SHARING CONTROLLING METHOD AND DISPLAY PANEL

RELATED APPLICATIONS

This application claims priority to Taiwan Application Ser. No. 102137726, filed Oct. 18, 2013, which is herein incorporated by reference.

BACKGROUND

Field of Invention

The present application relates to a charge-sharing controlling method. More particularly, the present application relates to a charge-sharing controlling method for a display driving circuit.

Description of Related Art

In order to prevent quality deterioration of the liquid crystal (e.g., afterimage) by constantly applying fixed voltage for a long time, the applied voltage must be varied continuously in the liquid crystal display (LCD). In general, the source driver used polarity inversion method (e.g., frame inversion, row inversion, column inversion, dot inversion, and two line inversion) to create voltage alternating in polarity.

For a LCD with sub-pixels in zigzag pattern, the driving method is usually column inversion. When displaying white or black on the LCD under this structure, the voltage applied does not need to vary continuously. Therefore the LCD has lower power consumption.

However, when aforesaid LCD is used to display other colors, data voltages applied on the liquid crystal must be switched between high and low voltage levels, especially when the LCD is utilized to display primary colors (e.g., pure red, pure green, pure blue, pure cyan, pure yellow and pure magenta). In order to maintain the same primary color screen between subsequent frames, data voltages on the same data line must be switched between high level and low level at a high frequency. The data voltage on the corresponding data line must be switched from the high level to the low level or from the low level to the high level each time when the polarity is inversed. Therefore, the power consumption of the LCD is increased.

SUMMARY

An aspect of the present disclosure is to provide a charge-sharing controlling method, which is suitable for a display panel including a plurality of sub-pixels. The charge-sharing controlling method includes steps of: determining whether the display panel is utilized to display a primary color screen; and, if the display panel is displaying the primary color screen, prolonging an activated time of a charge-sharing circuit. The charge-sharing circuit is coupled between any two of the sub-pixels displaying the same color, adjacent to each other and having opposite polarities.

Another aspect of the present disclosure is to provide a display panel, which includes a plurality of sub-pixels, a charge-sharing circuit, a timing controller and a source driver circuit. The charge-sharing circuit is coupled between any two of the sub-pixels displaying the same color, adjacent to each other and having opposite polarities. The timing controller is configured for generating a timing control signal. The charge-sharing circuit is activated when the timing control signal is configured at an active level. The source driver circuit is configured for generating a data signal for driving the sub-pixels. The source driver circuit includes a determining unit and an adjusting unit. The determining unit is configured for determining whether the data signal is utilized to display a primary color screen on the display panel. If the data signal is determined to be utilized to display the primary color screen, the adjusting unit triggers the timing controller to adjust the timing control signal, so as to prolong a time interval of the timing control signal at the active level.

Another aspect of the present disclosure is to provide a display panel, which includes a plurality of sub-pixels, a charge-sharing circuit, a timing controller and a source driver circuit. The charge-sharing circuit is coupled between any two of the sub-pixels displaying the same color, adjacent to each other and having opposite polarities. The source driver circuit is configured for generating a data signal for driving the sub-pixels. The timing controller is configured for generating a timing control signal. The charge-sharing circuit is activated when the timing control signal is configured at an active level. The timing controller includes a determining unit and an adjusting unit. The determining unit is configured for determining whether the data signal outputted from the source driver circuit is utilized to display a primary color screen on the display panel. If the data signal is determined to be utilized to display the primary color screen, the adjusting unit adjusts the timing control signal generated by the timing controller, so as to prolong a time interval of the timing control signal at the active level.

BRIEF DESCRIPTION OF THE DRAWINGS

The disclosure can be more fully understood by reading the following detailed description of the embodiments, with reference made to the accompanying drawings as follows.

DETAILED DESCRIPTION

In the following description, several specific details are presented to provide a thorough understanding of the embodiments of the present disclosure. One skilled in the relevant art will recognize, however, that the present disclosure can be practiced without one or more of the specific details, or in combination with or with other components, etc. In other instances, well-known implementations or operations are not shown or described in detail to avoid obscuring aspects of various embodiments of the present disclosure.

Figure 1:
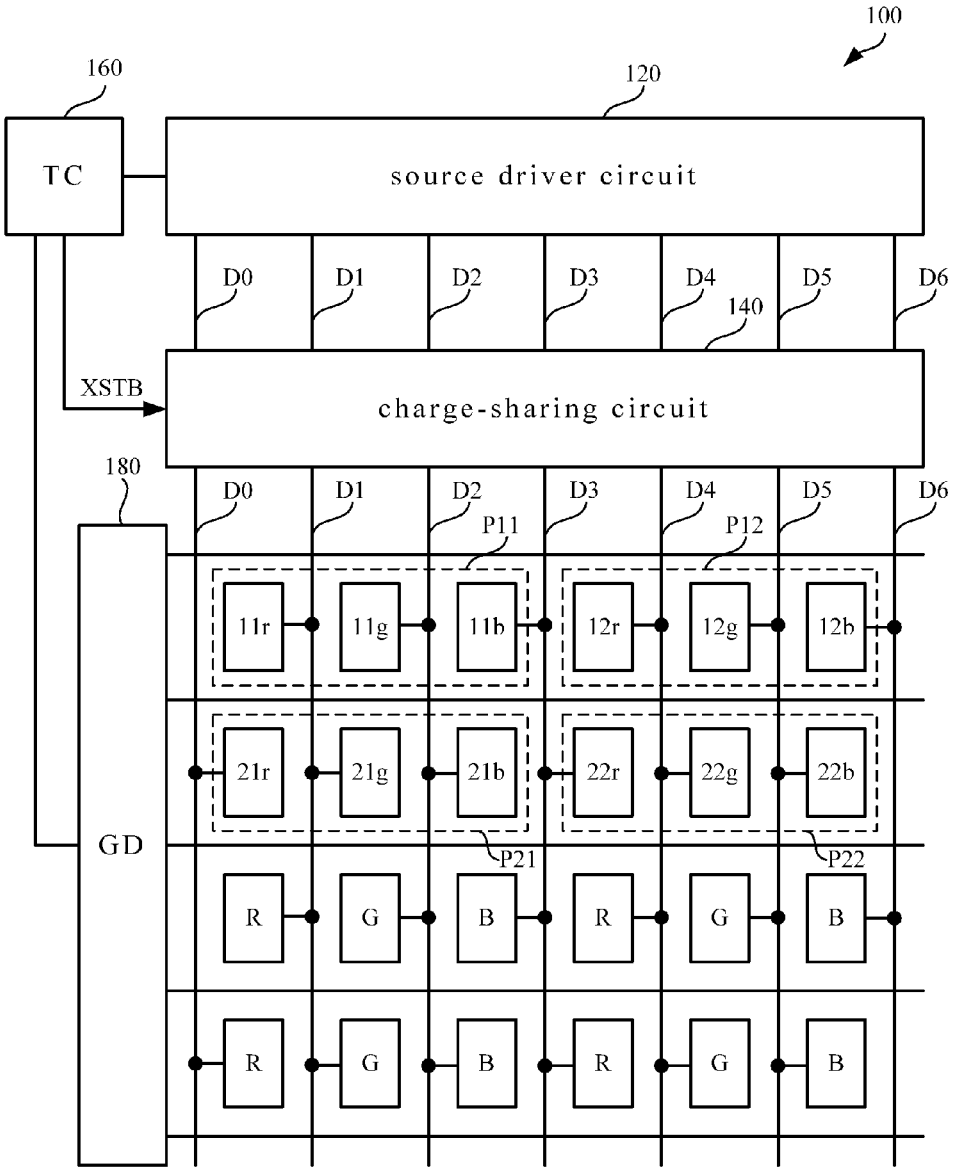
FIG. 1 is a schematic diagram illustrating a display panel according to an embodiment of this disclosure.

Reference is made to FIG. 1. FIG. 1 is a schematic diagram illustrating a display panel 100 according to an embodiment of this disclosure. The display panel 100 includes multiple pixels arranged in an array (e.g., pixels P11, P12, P21, P22 are illustrated in FIG. 1 for demonstration). Each of the pixels P11~P22 includes multiple sub-pixels. For example, the pixel p11 includes a sub-pixel 11*r* for displaying a red color, another sub-pixel 11*g* for displaying a green color, and another sub-pixel 11*b* for displaying a blue color. Similarly, the pixel p12 includes a sub-pixel 12*r*, another sub-pixel 12*g* and another sub-pixel 12*b*. The pixel p21 includes a sub-pixel 21*r*, another sub-pixel 21*g*, and another sub-pixel 21*b*. The pixel p22 includes a sub-pixel, another sub-pixel 22*g* and another sub-pixel 22*b*.

As shown in FIG. 1, the display panel 100 includes source driver circuit 120, a charge-sharing circuit 140, a timing controller (TCON) 160, and a gate driver circuit 180.

The source driver circuit 120 is utilized to generate a data signal. The data signal is utilized drive aforesaid sub-pixels 11*r*~22*b* with various colors through data lines D0~D6. The data signal charges the pixel capacitors of the sub-pixels 11*r*~22*b*, so to show different displaying screen. On the other hand, the gate driver circuit 180 is utilized to turn on/off pixel-switches of the sub-pixels 11*r*~22*b*. Driving the sub-pixels 11*r*~22*b* by the source driver circuit 120 and the gate driver circuit 180 is a known technique, and not to be further explained here.

The charge-sharing circuit 140 is coupled between the sub-pixels 11*r*~22*b* and the source driver circuit 120. The charge-sharing circuit 140 is used to couple two data lines with different polarities when a polarity inversion is performed by the source driver circuit 120. By coupling two data lines with opposite polarities, the charge-sharing circuit 140 couples any two sub-pixels with opposite polarities. Therefore, when the charge-sharing is performed between at least two data lines with opposite polarities, the data signal provided by source driver circuit 120 is not necessarily required to switch from a low level to a high level (or from the high level to the low level) when the polarities of the sub-pixels are inverted. The high/low levels of opposite polarities can be modulated to an intermediate level in advance by the charge-sharing, such that the power consumption of the source driver circuit 120 can be reduced.

The timing controller 160 is used to generate a timing control signal XSTB. When a level of the timing control signal XSTB is configured at an active level (e.g., a high level is regarded as the active level in some embodiment), the timing controller 160 is used to activate the charge-sharing circuit 140 to enable the charge-sharing function. A time interval of the timing control signal staying at the active level determines an active period of the charge-sharing function.

With the development of LCD technology, the display panel 100 developed to achieve a high resolution, such as full high definition (FHD, 1920*1080), or 4K2K (3840*2160 or 4096*2160). Under a refresh rate at 60 Hz, a total driving time allocated to each sub-pixel is quite short. In addition, the total driving time for each sub-pixel must be divided into a charge-sharing interval utilized by the charge sharing circuit 140 and a pixel charging interval utilized by the source driver circuit 120.

If the charge sharing interval occupies too much time, the pixel capacitor can not be charged completely, such that the color saturation is reduced and the color-biasing may occur. If the charge-sharing interval is too short, the power saving effect of charge-sharing would be reduced drastically. Thus, timing controller 160 of the display panel 100 in this disclosure is configured for generating a different timing control signal XSTB according to different screen to be displayed, so as to dynamically adjust the active interval of the charge-sharing function. The details of aforesaid method are described below.

Figure 2:
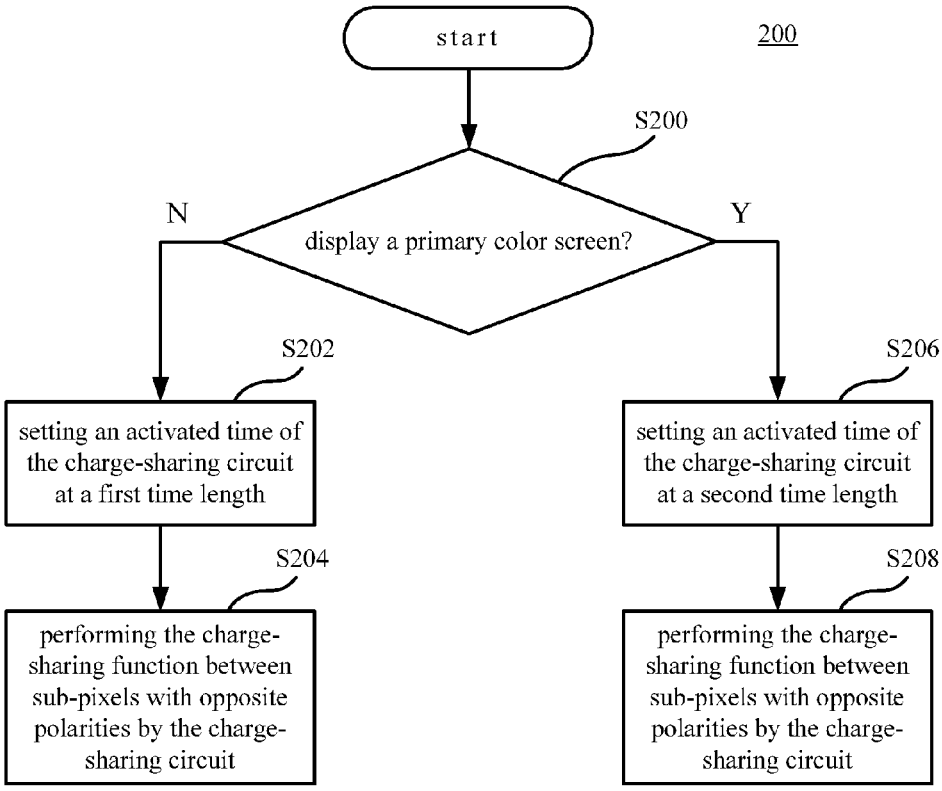
FIG. 2 is a flow diagram illustrating a charge-sharing controlling method according to an embodiment of the disclosure.

Reference is also made to FIG. 2. FIG. 2 is a flow diagram illustrating a charge-sharing controlling method 200 according to an embodiment of the disclosure. In this embodiment, the charge-sharing controlling method 200 is suitable to be operated with the display panel 100 in the embodiment shown in FIG. 1.

As shown in FIG. 2, the charge-sharing controlling method 200 executes step S200 to determine whether display panel 100 is utilized to display a primary color screen. In this embodiment, whether the display panel is utilized to display the primary color screen is determined by detecting whether the panel is utilized to display any one of a pure red (R) screen, a pure green (G) screen or a pure blue (B) screen. In some embodiments, the primary color screen further includes any one of a pure cyan (GB) screen, a pure yellow (RG) screen or a pure magenta (RB) screen. For example, if all the sub-pixies for displaying the red color (e.g. the sub-pixels 11*r*, 12*r*, 21*r*, and 22*r*) are lit up and all the other sub-pixels are dimmed down, it is determined that the display panel 100 is displaying a pure red screen, which belongs to the primary color screen. If all the sub-pixels for displaying the red color and the green color (e.g., the sub-pixels 11*r*, 11*g*, 12*r*, 12*g*, 21*r*, 21*g*, 22*r*, and 22*g*) are lit and all the other sub-pixels are dimmed down, it is determined that the display panel 100 is displaying a pure yellow screen, which also belongs to the primary color screen. If the sub-pixels with three colors have different luminance settings, it is determined that the display panel 100 is not displaying the primary color screen.

Figure 3A:
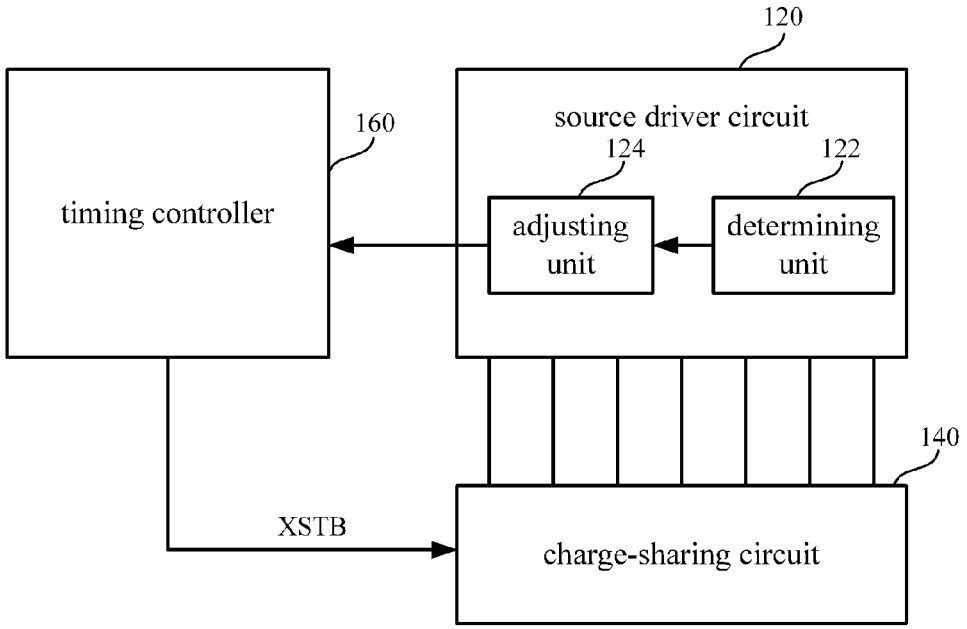
FIG. 3A is a functional block diagram illustrating the source driver circuit, the charge-sharing circuit, and the timing controller according to the embodiment shown in FIG. 1.

Reference is also made to FIG. 3A. FIG. 3A is a functional block diagram illustrating the source driver circuit 120, the charge-sharing circuit 140, and the timing controller 160 according to the embodiment shown in FIG. 1.

In the embodiment of FIG. 3A, the source drive circuit 120 includes a determining unit 122 and an adjusting unit 124. The determining unit 122 is configured for determining whether the data signal outputted from the source driver circuit 120 is utilized to display the primary color screen on the display panel 100 (e.g., step S200).

If the determining unit 122 determines that the data signal is not utilized for displaying the primary color screen, step S202 is executed to setting an activated time of the charge-sharing circuit at a first time length (e.g., a standard time length for charge-sharing function). Afterward, step S204 is executed for performing the charge-sharing function between sub-pixels with opposite polarities by the charge-sharing circuit 140.

Figure 4:
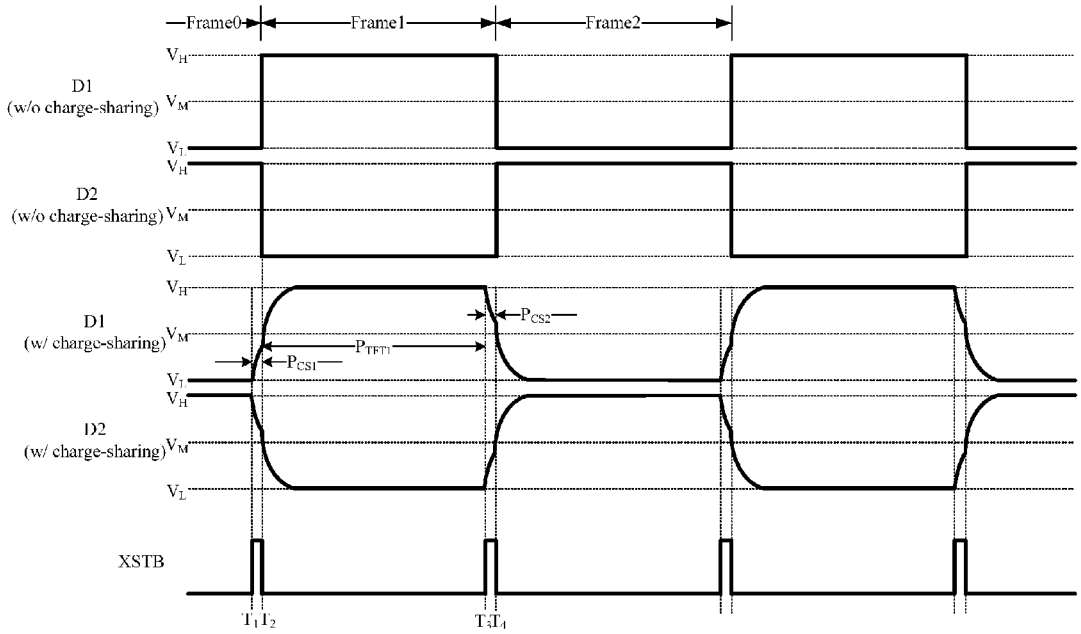
FIG. 4 is a schematic diagram illustrating waveform of signals when the activated time of the charge-sharing circuit is set to the first time length in an embodiment.

Reference is also made to FIG. 4. FIG. 4 is a schematic diagram illustrating waveform of signals when the activated time of the charge-sharing circuit is set to the first time length in an embodiment. In the embodiment of FIG. 4, the sub-pixels connected by the data lines D1 and D2 have opposite polarities.

In addition, each of the sub-pixels on the data line D1 and the data line D2 adopt opposite polarities between a display frame Frame0 and a subsequent display frame Frame1, and the polarities are also opposite between the display frame Frame1 and a subsequent display frame Fame2. For example, the data line D1 is changed from a negative polarity to a positive polarity between the display frame Frame0 and the subsequent display frame Frame1, and then changed from the positive polarity to the negative polarity between the display frame Frame1 and the subsequent display frame Frame2. The data line D2 is changed from the positive polarity to the negative polarity between the display frame Frame0 and the subsequent display frame Frame1, and then changed from the negative polarity to the positive polarity between the display frame Frame1 and the subsequent display frame Frame2.

Because each pair of the sub-pixels on the data line D1 and the data line D2 have opposite polarities as described above, the charge-sharing circuit 140 can perform the charge-sharing function between the data line D1 and the data line D2. In practical applications, the charge-sharing function is limited to be performed on the data line D1 and the data line D2. Any pair of data lines with opposite polarities as described above can adopt the charge-sharing function between different display frames with opposite polarities.

As shown in FIG. 4, the timing control signal XSTB is at active level between a time point $T_1$ to another time point $T_2$ (i.e., the charge-sharing interval $P_{CS1}$) and between a time point $T_3$ to another time point $T_4$ (i.e., the charge sharing interval $P_{cs2}$). The charge-sharing function between the data line D1 and the data line D2 is activated from the time point $T_1$, such that a voltage level on the data line D1 is changed from a high level $V_H$ to an intermediate level $V_M$, and a voltage level on the data line D2 is changed from a low level $V_L$ to the intermediate level $V_M$.

When the panel is not displaying the primary color screen, first time lengths of the charge-sharing interval $P_{CS1}$ and the charge-sharing interval $P_{CS2}$ are shorter, such that the data line D1 and the data line D2 can not be charged/discharged from the high level $V_H$ or the low level $V_L$ to the intermediate level $V_M$ in the shorter period of time (e.g., the data signal on D1/D2 does not reach the intermediate level $V_M$ at the time point $T_2/T_4$). In this case, the power saving effect of the charge-sharing function is relatively short.

When a basic driving time for each sub-pixel (i.e., the time for driving a single display frame Frame0, Frame1, or Frame2) is fixed, the pixel charging interval $P_{TFT1}$ between time point $T_2$~$T_3$ is relatively longer in this case. Therefore, there is enough time reversed for the pixel charging interval $P_{TFT1}$, so as to prevent the pixel capacitors from incomplete charging, maintain the color saturation, and reduce color biasing.

Figure 5:
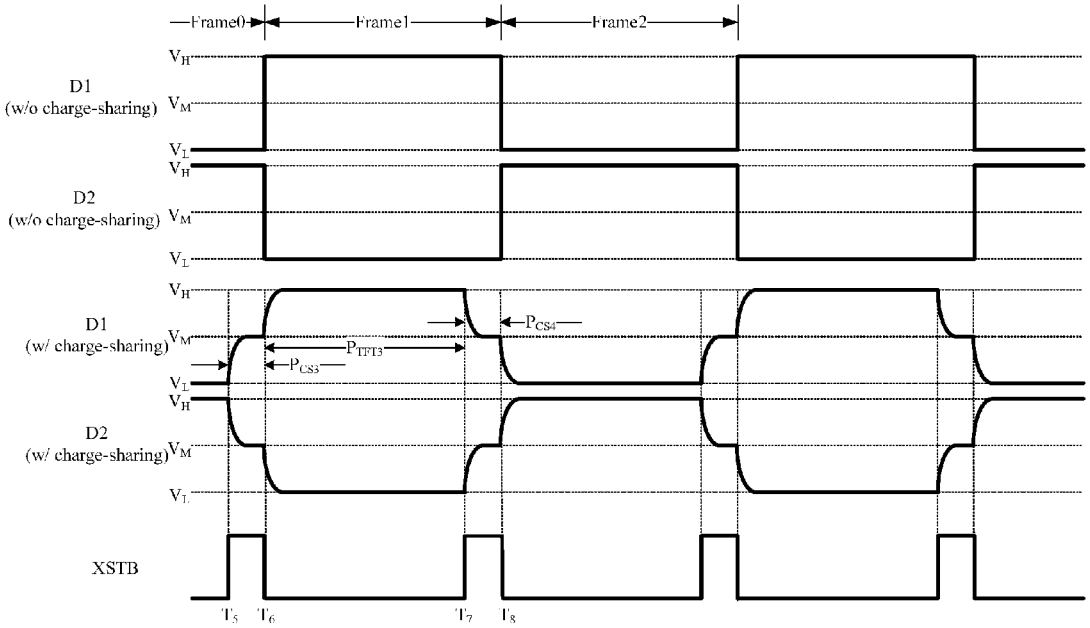
FIG. 5 is a schematic diagram illustrating related signals when the activated time of the charge-sharing circuit is set to the second time length.

If the determining unit 122 determines that the data signal is utilized to display the primary color screen (e.g., a full red screen, a full green screen, a full blue screen, a full cyan screen, a full yellow screen or a full magenta screen), the step S206 is executed. The adjusting unit 124 of the source driver circuit 120 triggers the timing controller 160 to adjust the activated time of the charge-sharing circuit 140, by adjusting an active time of the timing control signal XSTB to a second time length. The second time length is longer than the first time length, so as to prolong the time of the timing control signal XSTB staying in the active level (the activated time for charge-sharing). Then, the step S208 is executed for performing charge-sharing function between the sub-pixels with opposite polarities by the charge sharing circuit 140. Reference is also made to FIG. 5. FIG. 5 is a schematic diagram illustrating related signals when the activated time of the charge-sharing circuit 140 is set to the second time length.

As shown in FIG. 5, the timing control signal XSTB is configured at the active level between the time point $T_5$ to the time point $T_6$ (the charge-sharing interval $P_{CS3}$) and the time point $T_7$ to the time point $T_8$ (charge sharing interval $P_{cs4}$). Started from the time point T5, the voltage level of the data line D1 is changed from the high level $V_H$ to the intermediate level $V_M$ gradually, and the voltage level of the data line D2 is changed from the low level $V_L$ to the intermediate level $V_M$ gradually, because the charge-sharing function is activated between the data line D1 and the data line D2. In this case, the voltage levels of the data line D1 and the data line D2 have enough time to reach the intermediate level $V_M$ before the time point $T_6$.

When the primary color screen is displayed, the timing control signal XSTB remains at the active level by the longer second time length. In other words, the charge-sharing interval Pcs3 and the charge-sharing interval Pcs4 last the longer second time length, such that the voltage level on the data line D1 and the data line D2 have enough time to reach the intermediate level $V_M$, and the power saving effect of the charge-sharing function is relatively better.

In aforesaid embodiments, a lower bound of the second time length is configured according to a required time for two of the sub-pixels with opposite polarities to reach a balanced level.

When the basic driving time for each sub-pixel (i.e., the time for driving a single display frame Frame0, Frame1, or Frame2) is fixed, the pixel charging interval $P_{TFT2}$ between time point $T_6$~$T_7$ is relatively shorter in this case.

In aforesaid embodiments, an upper bound of the second time length of the timing control signal XSTB is configured in positively correlated to a displaying period of each display frame (e.g., the time length of each frame Frame0, Frame1, Frame2, etc) and in negatively correlated to a required charge time for a liquid crystal unit (or a pixel capacitor) of the display panel 100. In other words, if the displaying period of each display frame is longer, the second time length of the timing control signal XSTB is able to last longer. On the other hand, if the required charge time for the liquid crystal unit is shorter, the second time length of the timing control signal XSTB is able to last longer.

In a practical example, the first time length of the timing control signal XSTB lasts about 0.7 microsecond (ms) to 0.9 ms while displaying a non-primary color screen; the second time length of the timing control signal XSTB lasts about 1.5 microsecond (ms) to 3 ms while displaying the primary color screen. In other words, while displaying the primary color screen, the timing control signal XSTB provided by this embodiment can prolong the activated time of the charge-sharing circuit 140, so as to achieve better effect of power saving. However, the first time length and the second time length are not limit to the described range (0.7 ms~0.9 ms and 1.5 ms~3 ms) in aforesaid embodiment.

In fact, amount of transferred charges while charging/discharging an capacitor follow a relationship as:

$$Q=C\cdot V=I\cdot T$$

Q represents the amount of transferred charges. C represents the capacitance of the capacitor. V represents an operational voltage level while charging/discharging. I represents the current while charging/discharging. T represents the first time length or the second time length. In this embodiment, the first time length and second time length are in positively proportional to the pixel capacitance of the sub-pixels (11r~22b) in display panel 100. When the pixel capacitance is larger, the first time length and second time length must be longer. Also, the first time length and second time length are in positively proportional to the operational voltage level $V_{DD}$ in display panel 100 (not shown in the figure, and is referred to $V_H$ shown in FIG. 4 and FIG. 5). When the operational voltage level $V_{DD}$ for the display panel 100 is higher, the first time length and the second time length are required to be longer. The second time length is always longer than the first time length in embodiments of the disclosure.

Figure 3B:
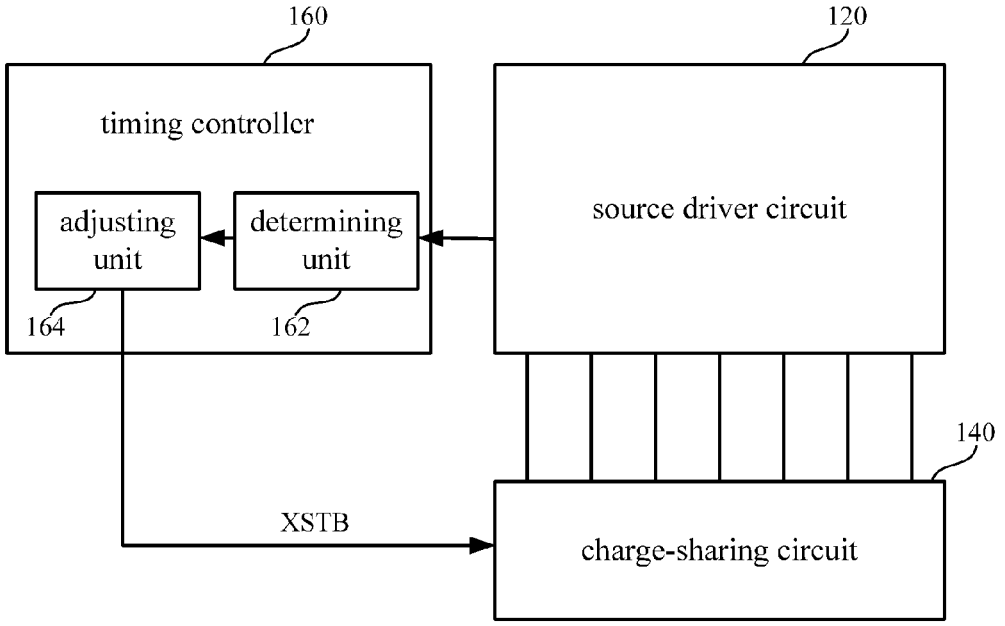
FIG. 3B is a functional block diagram illustrating the source driver circuit, the charge-sharing circuit, and the timing controller shown in FIG. 1 according to another embodiment of this disclosure.

In the embodiment above and FIG. 3A, the source driver circuit 120 includes the determining unit 122 and the adjusting unit 124. The source driver circuit 120 determines whether the primary color screen is displayed and triggers time adjustment of the timing control signal XSTB. However, the disclosure is not limited to aforesaid embodiments. Reference is also made to FIG. 3B. FIG. 3B is a functional block diagram illustrating the source driver circuit 120, the charge-sharing circuit 140, and the timing controller 160 shown in FIG. 1 according to another embodiment of this disclosure.

In the embodiment show in FIG. 3B, the timing controller 160 includes a determining unit 162 and an adjusting unit 164. The determine uniting 162 is configured to read the data signal outputted from the source driver circuit 120 and determine whether the data signal is utilized for displaying the primary color screen on the display panel 100. If the data signal is determined to be utilized for displaying the primary color screen, the adjusting unit 164 prolongs the time of the timing control signal XSTB generated by timing controller 160 staying in the active level. Details of these procedures are described in aforesaid embodiments.

Figure 6:
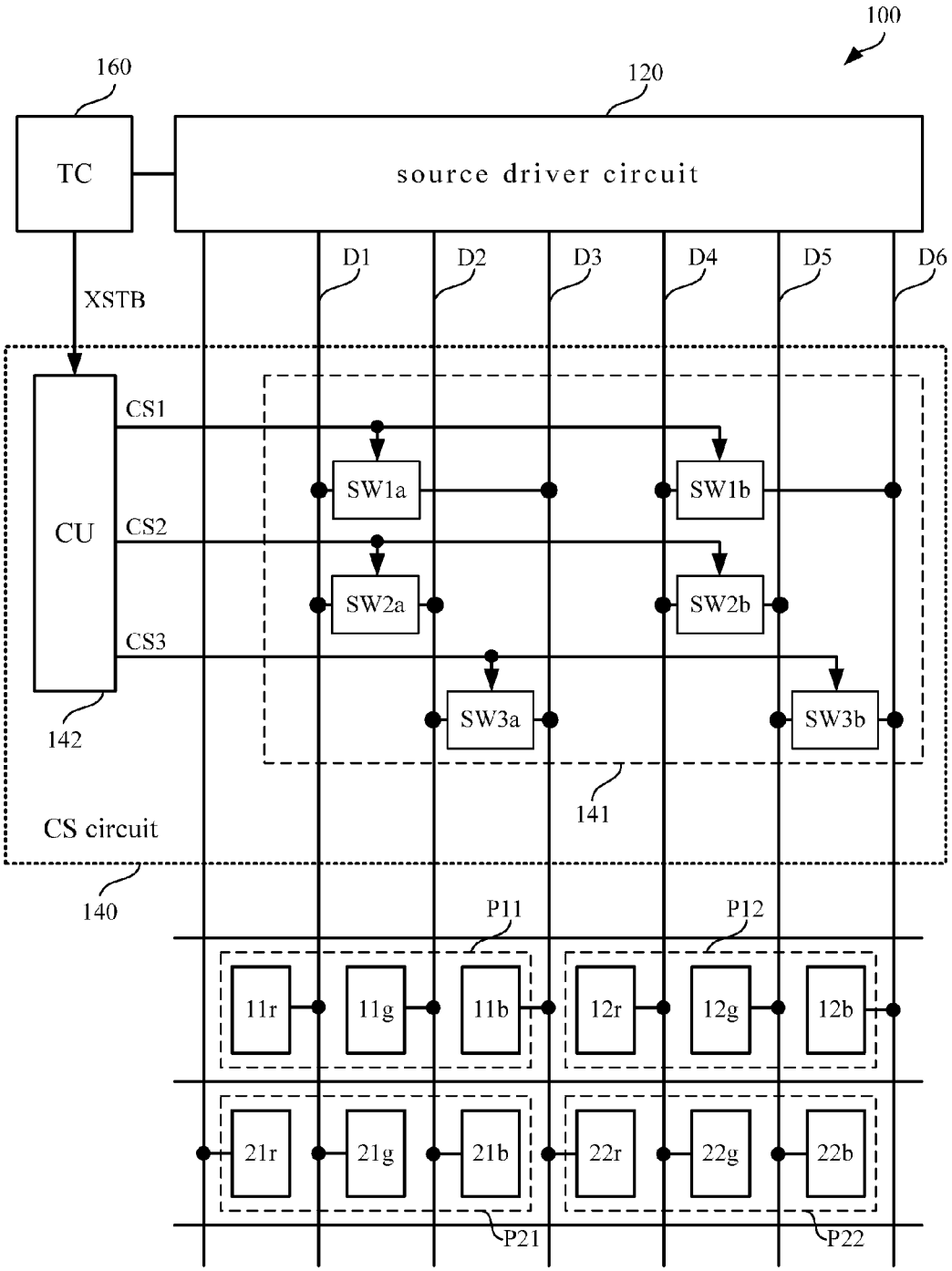
FIG. 6 is a circuit schematic diagram illustrating the display panel and the charge-sharing circuit according to the embodiment shown in FIG. 1.

Reference is made to FIG. 6. FIG. 6 is a circuit schematic diagram illustrating the display panel 100 and the charge-sharing circuit 140 according to the embodiment shown in FIG. 1.

In the embodiment of FIG. 6, the sub-pixels with different colors 11r~22b and the data line D0~D6 are disposed according to a zigzag pattern. In other words, the data line D1 is coupled to the sub-pixel 11r of the pixel P11 on the left side, and is also coupled to the sub-pixel 21g of the pixel P21 on the right side. The data line D2 is coupled to the sub-pixel 11g of the pixel P11 on the left side, and is also coupled to the sub-pixel 21b of the pixel P21 on the right side, and so on. The display panel 100 shown in FIG. 6 is driven under a column inversion manner.

In aforesaid embodiments, the charge-sharing circuit 140 is coupled between any two of the sub-pixels with opposite polarities. In this embodiment, the charge-sharing circuit 140 further includes a partial charge-sharing (PCS) circuit 141 and a control circuit 142 thereof. The partial charge-sharing circuit 141 includes a plurality of switches SW1a, SW1b, SW2a, SW2b, SW3a, and SW3b.

Each switch in the partial charge-sharing circuit 141 is coupled between any two sub-pixels with opposite polarities, adjacent to each other and utilized to display the same color. For example, the switch SW is coupled between the red sub-pixels 11r and 22r; the switch SW2a is coupled between the green sub-pixels 21g and 11g; the switch SW3a is coupled between blue sub-pixels 21b and 11b, and so on.

For the sub-pixels arranged in the zigzag pattern and under the column inversion manner, the data line D1 is required to be inversed in an order as high level, low level, high level, low level . . . and so on; the data line D2 is required to be inversed in an order as low level, high level, low level, high level . . . and so on; the data line D3 is required to be inversed in an order as high level, low level, high level, low level . . . and so on; the data line D4 is required to be inversed in an order as low level, high level, low level, high level . . . and so on; the data line D5 is required to be inversed in an order as high level, low level, high level, low level . . . and so on; the data line D6 is required to be inversed in an order as low level, high level, low level, high level . . . and so on.

While the pure red screen (or the pure cyan screen) is displaying, the data line D1 and the data line D3 have opposite polarities between subsequent display frames. In the mean time, the data line D4 and the data line D6 have opposite polarities between subsequent display frames. In this case, the control circuit 142 generates a control signal CS1 to turn on the switches SW1a and SW1b.

While the pure green screen (or the pure magenta screen) is displaying, the data line D1 and the data line D2 have opposite polarities between subsequent display frames. In the mean time, the data line D4 and the data line D5 have opposite polarities between subsequent display frames. In this case, the control circuit 142 generates another control signal CS2 to turn on the switches SW2a and SW2b.

While the pure blue screen (or the pure yellow screen) is displaying, the data line D2 and the data line D3 have opposite polarities between subsequent display frames. In the mean time, the data line D5 and the data line D6 have opposite polarities between subsequent display frames. In this case, the control circuit 142 generates another control signal CS3 to turn on the switches SW3a and SW3b.

In other words, the partial charge-sharing circuit 141 of the charge-sharing circuit 140 has multiple switches. Each of the switches is coupled between two of the sub-pixels 11r~22b with opposite polarities, adjacent to each other and utilized for displaying the same color. When specific pure color screen is displayed, the corresponding charge-sharing switches are turned on, and the activated time of the charge-sharing function is prolonged while displaying the primary color screen (reference is made to FIG. 5 and related descriptions).

The partial charge-sharing circuit 141 illustrated in embodiment of FIG. 6 is substantially disposed between adjacent sub-pixels with opposite polarities and displaying the same color, but the configuration of the partial charge-sharing circuit 141 is not limited thereto. In practical applications, the charge-sharing circuit 140 can further includes other switches or charge-sharing routes to perform the charge-sharing onto other sub-pixels with opposite polarities at other specific transform time points. The charge-sharing function is not limited to be performed between sub-pixels with the same color only. General settings of the charge-sharing circuit 140 are known technique, and not to be further explained here.

Figure 7:
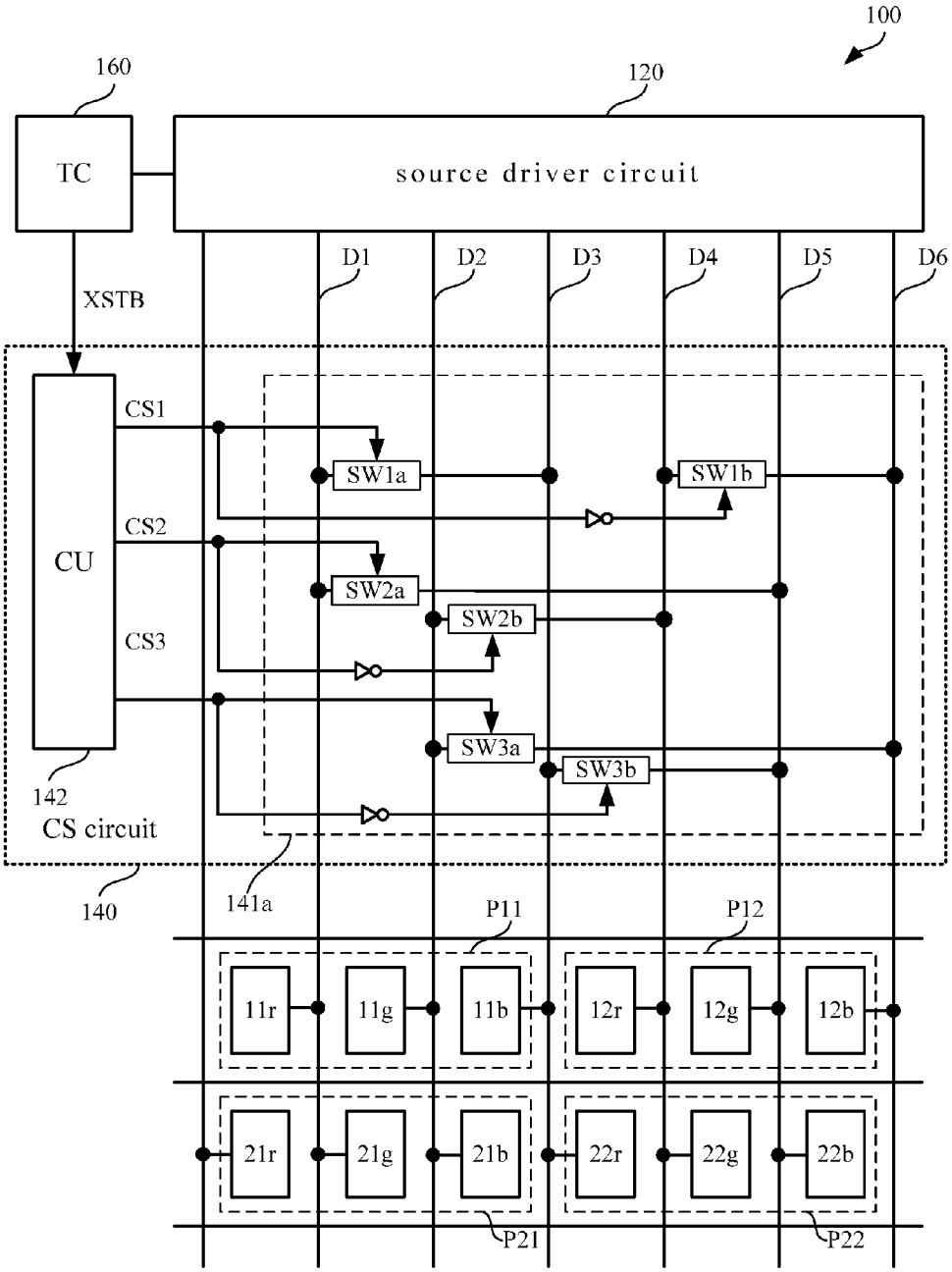
FIG. 7 is a circuit schematic diagram illustrating the display panel with a partial charge-sharing circuit according to another embodiment of the disclosure.

However, the partial charge-sharing circuit 141 in this disclosure is not limited to the structure shown in embodiments of FIG. 6. The charge-sharing circuit 140 can adopt any equivalent partial charge-sharing structure in other embodiments. Reference is made to FIG. 7, which is a circuit schematic diagram illustrating the display panel 100 with a partial charge-sharing circuit 141a according to another embodiment of the disclosure.

In the embodiment of FIG. 7, the sub-pixels with different colors 11r~22b and the data line D0~D6 are disposed according to a zigzag pattern. In this embodiment, the partial charge-sharing circuit 141a includes a plurality of switches SW1a, SW1b, SW2a, SW2b, SW3a, and SW3b.

Each switch in the partial charge-sharing circuit 141 is coupled between any two sub-pixels with the same polarity and utilized to display different color. For example, the switch SW is coupled between the sub-pixels 11*r* and 11*b*; the switch SW is coupled between the sub-pixels 12*r* and 12*b*; the switch SW2*a* is coupled between the sub-pixels 21*g* and 22*b*; the switch SW2*b* is coupled between the sub-pixels 11*g* and 12*r* and so on.

While the pure red screen is displaying, the data line D1 and the data line D3 have the same polarity (e.g., the positive polarity) within a display frame. In the mean time, the data line D4 and the data line D6 have the same polarity (e.g., the negative polarity) within a display frame. In this case, the control circuit 142 modulates a control signal CS1 to an activation level, so as to turn on the switches SW1*a* and SW1*b* (in this embodiment, the switches SW1*a* and SW1*b* have opposite control logics and triggered by opposite input signals to be turned on at the same time). When the switches SW1*a* and SW1*b* are turned on, the charge sharing occurs between the two data lines D1 and D3 and the other two data lines D4 and D6. In this case of displaying the pure red screen, the data line D1 (for driving the sub-pixel 11*r*) may be at a high reference voltage at a positive polarity, and the data line D3 (for driving the sub-pixel 11*b*) may be at a middle reference voltage at the positive polarity. The charge-sharing function by turning on the switch SW can reduce the voltage on the data line D1 toward the middle reference voltage. The data lines D1 and D3 are with the same polarity, and the data lines D4 and D6 are with the same polarity. In addition, the data lines D1 and D4 are with different polarities.

While the pure green screen is displaying, the data line D1 and the data line D5 have the same polarity (e.g., the positive polarity) within a display frame. In the mean time, the data line D2 and the data line D4 have the same polarity (e.g., the negative polarity) within a display frame. In this case, the control circuit 142 modulates another control signal CS2 to an activation level, so as to turn on the switch SW2*a* and the switch SW2*b* (in this embodiment, the switches SW2*a* and SW2*b* have opposite control logics and triggered by opposite input signals to be turned on at the same time). In addition, the data lines D1 and D2 are with different polarities.

While the pure blue screen is displaying, the data line D2 and the data line D6 (e.g., the positive polarity) have the same polarity within a display frame. In the mean time, the data line D3 and the data line D5 have the same polarity (e.g., the negative polarity) within a display frame. In this case, the control circuit 142 modulates another control signal CS3 to an activation level, so as to turn on the switch SW3*a* and the switch SW3*b* (in this embodiment, the switches SW3*a* and SW3*b* have opposite control logics and triggered by opposite input signals to be turned on at the same time). In addition, the data lines D2 and D3 are with different polarities.

While the pure yellow screen (i.e., combination of the red color and the green color) is displaying, the control circuit 142 modulates another control signal CS3 to an activation level, so as to turn on the switch SW3*a* and the switch SW3*b*.

While the pure cyan screen (i.e., combination of the green color and the blue color) is displaying, the control circuit 142 modulates another control signal CS1 to an activation level, so as to turn on the switch SW1*a* and the switch SW1*b*.

While the pure yellow screen (i.e., combination of the blue color and the red color) is displaying, the control circuit 142 modulates another control signal CS2 to an activation level, so as to turn on the switch SW2*a* and the switch SW2*b*.

In other words, the partial charge-sharing circuit 141*a* of the charge-sharing circuit 140 has multiple switches. Each of the switches is coupled between two of the sub-pixels 11*r*~22*b* with the same polarity within a display frame and utilized for displaying different colors. When specific pure color screen is displayed, the corresponding charge-sharing switches are turned on, and the activated time of the charge-sharing function is prolonged while displaying the primary color screen (reference is made to FIG. 5 and related descriptions).

Based on aforesaid embodiments, the charge-sharing controlling method and the display panel provided by this disclosure is able to share charges between sub-pixels with opposite polarities, and the activated time length of the charge-sharing function can be adjusted dynamically. The activated time is prolonged while displaying the primary color screen automatically, so as to achieve a better effect of power saving. The activation time is set to a standard length while displaying the non-primary color screen, so as to ensure the liquid crystal (or pixel capacitor) to have enough time for charging/discharging.

It will be apparent to those skilled in the art that various modifications and variations can be made to the structure of the present application without departing from the scope or spirit of the application. In view of the foregoing, it is intended that the present application cover modifications and variations of this application provided they fall within the scope of the following claims.

What is claimed is:

1. A charge-sharing controlling method, suitable for a display panel comprising a plurality of sub-pixels, the charge-sharing controlling method comprising:

determining whether the display panel is utilized to display a primary color screen; and if the display panel is displaying the primary color screen, prolonging an activated time of a charge-sharing circuit, the charge-sharing circuit being coupled between any two of the sub-pixels displaying the same color, adjacent to each other and having opposite polarities;

if the display panel is not displaying the primary color screen, setting the activated time of the charge-sharing circuit at a first time length; and if the display panel is displaying the primary color screen, setting the activated time of the charge-sharing circuit at a second time length, wherein the second time length is longer than the first time length;

wherein the first time length and the second time length are positively correlated to pixel capacitances of the sub-pixels, and also positively correlated to an operational voltage level on the display panel.

2. The charge-sharing controlling method of claim 1, wherein, whether the display panel is utilized to display the primary color screen is determined by detecting whether the panel is utilized to display any one of a pure red (R) screen, a pure green (G) screen, a pure blue (B) screen, a pure cyan (GB) screen, a pure yellow (RG) screen or a pure magenta (RB) screen.

3. The charge-sharing controlling method of claim 1, wherein a lower bound of the second time length is configured according to a required time for two of the sub-pixels with opposite polarities to reach a balanced level, and a upper bound of the second time length is configured in positively correlated to a displaying period of each display frame and in negatively correlated to a required charge time for a liquid crystal unit of the display panel.

4. The charge-sharing controlling method of claim 1, wherein each of the sub-pixels adopts opposite polarities in a first display frame and in a second display frame subsequent to the first display frame.

5. The charge-sharing controlling method of claim 1, wherein the display panel comprises a source driver circuit, the source driver circuit is utilized to activate the charge-sharing circuit when a timing control signal is configured at an active level, the charge-sharing controlling method comprises:

determining whether a data signal outputted from the source driver circuit is utilized to display the primary color screen on the display panel by the source driver circuit; and if the data signal is utilized to display the primary color screen, adjusting the timing control signal for prolonging a time interval of the timing control signal at the active level.

6. The charge-sharing controlling method of claim 1, wherein the display panel comprises a timing controller for generating a timing control signal, the timing control signal is utilized to activate the charge-sharing circuit when the timing control signal is configured at an active level, the timing controller receives a data signal, the charge-sharing controlling method comprises:

determining whether a data signal is utilized to display the primary color screen on the display panel by the timing controller; and if the data signal is utilized to display the primary color screen, prolonging a time interval of the timing control signal at the active level by the timing controller.

7. A display panel, comprising:

a plurality of sub-pixels;

a charge-sharing circuit coupled between any two of the sub-pixels displaying the same color, adjacent to each other and having opposite polarities;

a timing controller, configured for generating a timing control signal, the charge-sharing circuit being activated when the timing control signal is configured at an active level; and a source driver circuit, configured for generating a data signal for driving the sub-pixels, and the source driver circuit comprising:

a determining unit, configured for determining whether the data signal is utilized to display a primary color screen on the display panel; and an adjusting unit, if the data signal is determined to be utilized to display the primary color screen, the adjusting unit triggering the timing controller to adjust the timing control signal, so as to prolong a time interval of the timing control signal at the active level;

wherein if the data signal is not determined to be utilized to display the primary color screen, the adjusting unit triggers the timing controller to adjust an activated time of the charge-sharing circuit at a first time length; and if the data signal is determined to be utilized to display the primary color screen, the adjusting unit triggers the timing controller to adjust the activated time of the charge-sharing circuit at a second time length, wherein the second time length is longer than the first time length;

wherein the first time length and the second time length are positively correlated to pixel capacitances of the sub-pixels, and also positively correlated to an operational voltage level on the display panel.

8. A display panel, comprising:

a plurality of sub-pixels;

a charge-sharing circuit coupled between any two of the sub-pixels displaying the same color, adjacent to each other and having opposite polarities;

a source driver circuit, configured for generating a data signal for driving the sub-pixels; and a timing controller, configured for generating a timing control signal, the charge-sharing circuit being activated when the timing control signal is configured at an active level, and the timing controller comprising:

a determining unit, configured for determining whether the data signal outputted from the source driver circuit is utilized to display a primary color screen on the display panel; and an adjusting unit, if the data signal is determined to be utilized to display the primary color screen, the adjusting unit adjusting the timing control signal generated by the timing controller, so as to prolong a time interval of the timing control signal at the active level;

wherein if the data signal is not determined to be utilized to display the primary color screen, the adjusting unit adjusts an activated time of the charge-sharing circuit at a first time length; and if the data signal is determined to be utilized to display the primary color screen, the adjusting unit adjusts the activated time of the charge-sharing circuit at a second time length, wherein the second time length is longer than the first time length;

wherein a lower bound of the second time length is configured according to a required time for two of the sub-pixels with opposite polarities to reach a balanced level, and a upper bound of the second time length is configured in positively correlated to a displaying period of each display frame and in negatively correlated to a required charge time for a liquid crystal unit of the display panel.

* * * * *